US008678608B2

(12) United States Patent
Lin

(10) Patent No.: US 8,678,608 B2
(45) Date of Patent: Mar. 25, 2014

(54) LAMP DEVICE

(76) Inventor: Chen-Chieh Lin, Taichung (TW)

( * ) Notice: Subject to any disclaimer, the term of this patent is extended or adjusted under 35 U.S.C. 154(b) by 176 days.

(21) Appl. No.: 13/429,642

(22) Filed: Mar. 26, 2012

(65) Prior Publication Data

US 2013/0128564 A1 May 23, 2013

(30) Foreign Application Priority Data

Nov. 17, 2011 (TW) ..... 100221725 U

(51) Int. Cl.
*F21L 4/02* (2006.01)
*F21L 4/00* (2006.01)

(52) U.S. Cl.
USPC ..... 362/184; 362/157; 362/190

(58) Field of Classification Search
USPC ..... 362/208, 157, 190, 184, 194
See application file for complete search history.

(56) References Cited

U.S. PATENT DOCUMENTS

2006/0092629 A1* 5/2006 Chen ..... 362/157
2006/0120080 A1* 6/2006 Sipinski et al. ..... 362/253
2007/0177378 A1* 8/2007 Wu et al. ..... 362/184
2008/0304255 A1* 12/2008 Cauchois ..... 362/183

* cited by examiner

*Primary Examiner* — Anh Mai
*Assistant Examiner* — Elmito Breval
(74) *Attorney, Agent, or Firm* — Davidson Berquist Jackson & Gowdey, LLP

(57) ABSTRACT

A lamp device includes: a battery housing receiving a battery set and a circuit board; a lamp casing enclosing and connected movably to the battery housing such that the lamp casing is movable relative to the battery housing in an axial direction; an LED lighting unit mounted in and connected fixedly to the lamp casing, and disposed spacedly above the circuit board; and a power switch mounted on the circuit board and connected electrically between the LED lighting unit and the battery set. The power switch is actuated in response to movement of the LED lighting unit toward the circuit board by press of the lamp casing to switch from a current one of power-on and power-off states to the other one of the power-on and power-off states.

10 Claims, 6 Drawing Sheets

LAMP DEVICE

BACKGROUND OF THE INVENTION

1. Field of the Invention

The invention relates to an illumination apparatus, and more particularly to a lamp device.

2. Description of the Related Art

A conventional night light is usually connected electrically to an indoor socket, and is not suitable for outdoor use. On the other hand, for a night light installed with a light bulb, overheating and higher power consumption of the light bulb may occur.

SUMMARY OF THE INVENTION

Therefore, an object of the present invention is to provide a lamp device that can overcome the aforesaid drawbacks of the prior art.

According to the present invention, a lamp device comprises:

a power unit including a battery housing adapted for receiving a battery set therein, and a circuit board disposed fixedly in the battery housing and adapted to be connected electrically to the battery set received in the battery housing;

a lamp casing enclosing the power unit, and connected movably to the battery housing such that the lamp casing is movable relative to the battery housing in an axial direction;

an LED lighting unit mounted in and connected fixedly to the lamp casing, and disposed spacedly above the circuit board of the power unit; and a power switch mounted on the circuit board and connected electrically between the LED lighting unit and the battery set received in the battery housing, the power switch being operable between a power-on state, where the LED lighting unit is connected electrically to the battery set via the power switch such that the LED lighting unit emits light in response to supply of electric power from the battery set, and a power-off state, where the LED lighting unit is disconnected electrically from the battery set received in the battery housing.

When the lamp casing is pressed to move the LED lighting unit toward the circuit board, the power switch is actuated in response to movement of the LED lighting unit toward the circuit board to switch from a current one of the power-on and power-off states to the other one of the power-on and power-off states.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
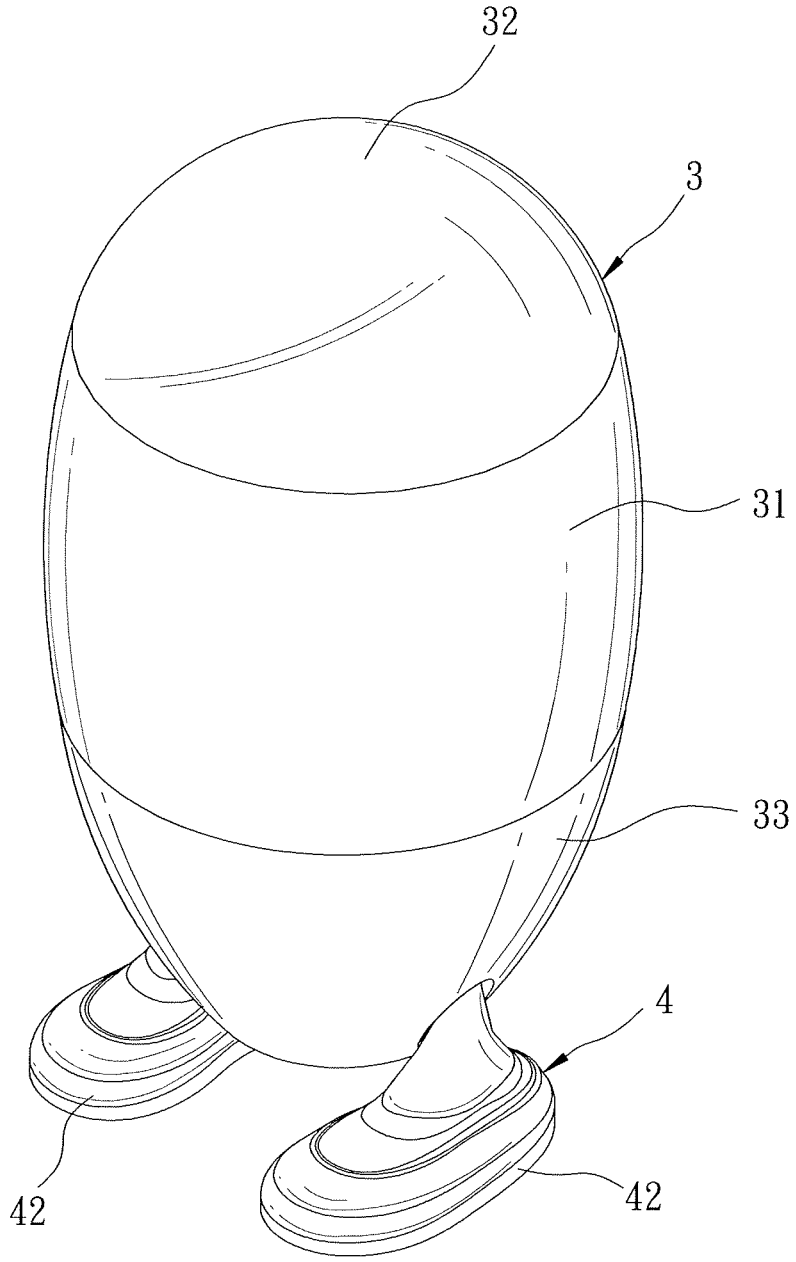
FIG. 1 is a perspective view showing the preferred embodiment of a lamp device according to the present invention.
Figure 2:
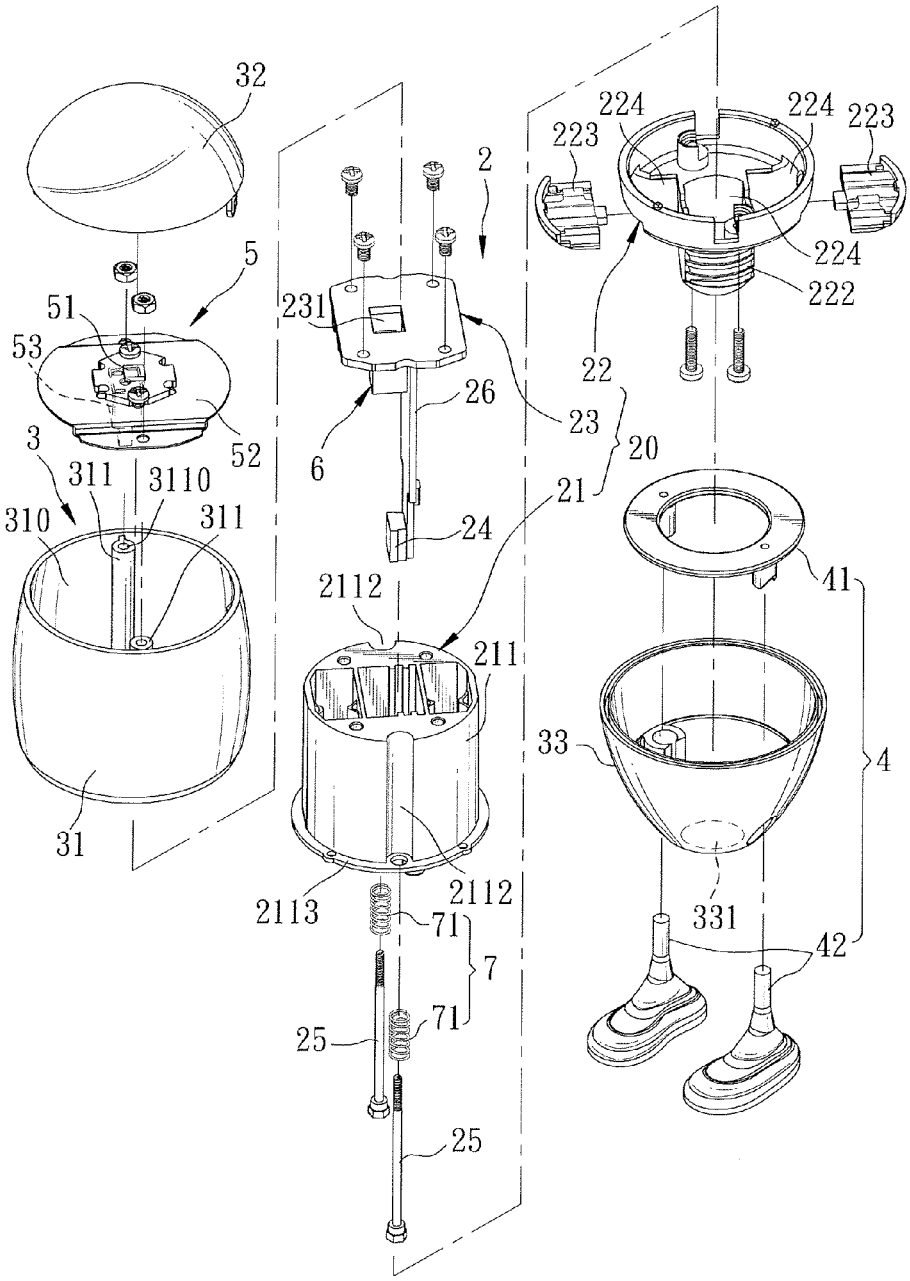
FIG. 2 is an exploded perspective view showing the preferred embodiment.
Figure 3:
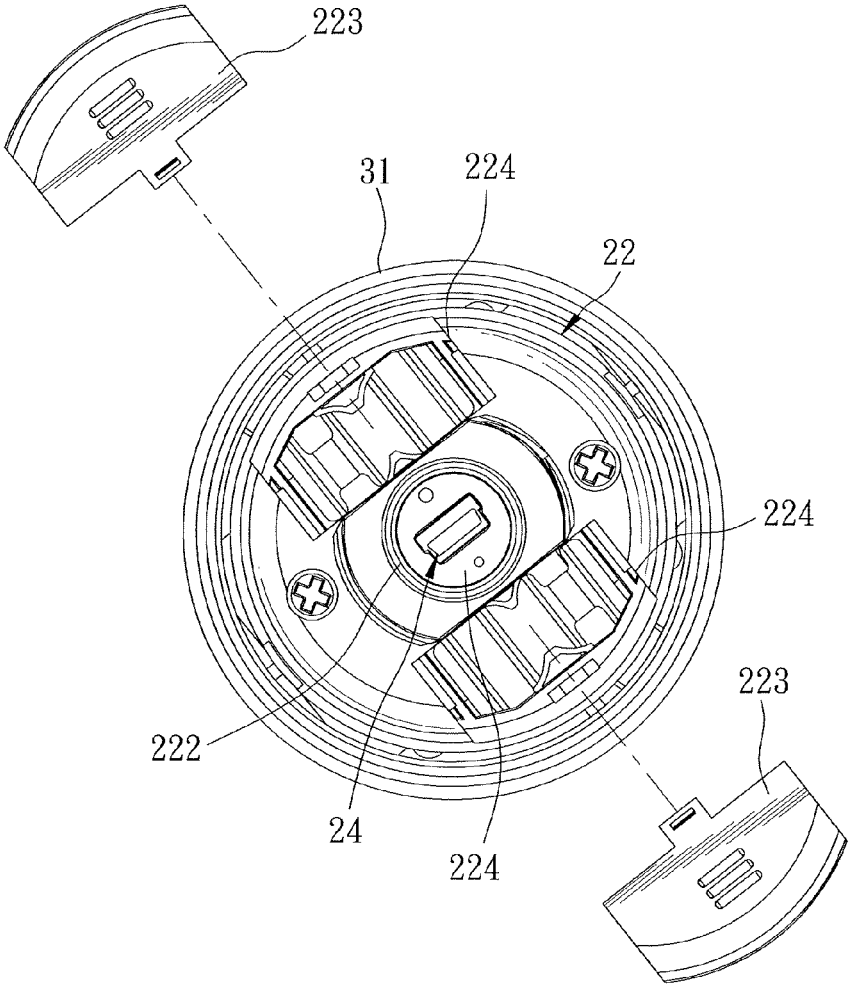
FIG. 3 is a partly exploded schematic bottom view showing the preferred embodiment without a base unit.
Figure 4:
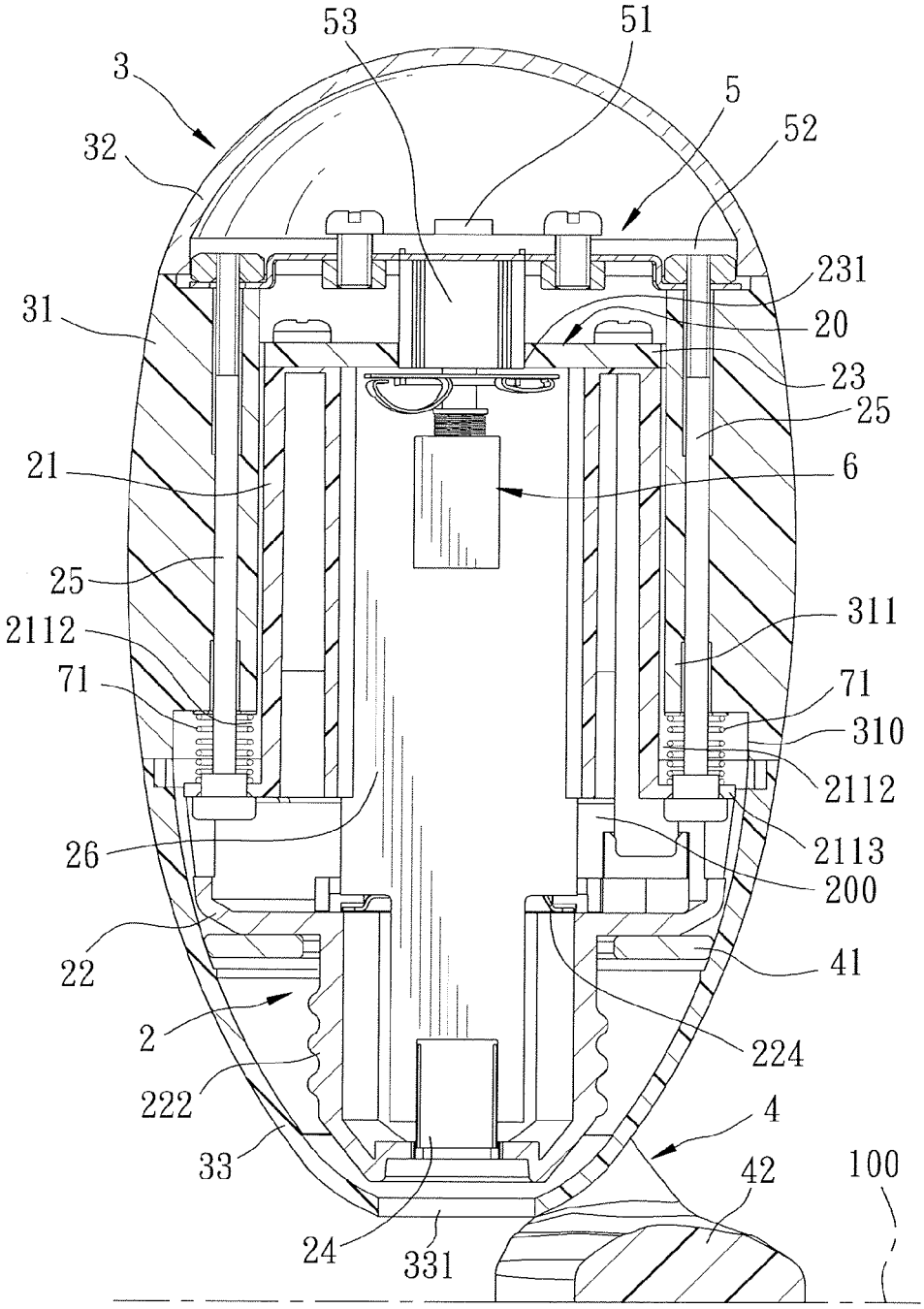
FIG. 4 is a schematic sectional view showing the preferred embodiment.

Referring to FIGS. 1, 2 and 4, the preferred embodiment of a lamp device according to the present invention is shown to include a power unit 2, a lamp casing 3, a base unit 4, an LED lighting unit 5, a power switch 6, and a biasing member 7.

The power unit 2 includes a battery housing 20, a circuit board 26, and a USB connector 24.

The battery housing 20 is adapted for receiving a battery set (not shown) therein. In this embodiment, the battery set includes two rechargeable batteries. The battery housing 20 includes a hollow main body 21, a cover plate 23, an annular connecting seat 22, and two cover bodies 223. The hollow main body 21 extends in an axial direction. In this embodiment, the main body 21 has an outer annular surface 211 formed with opposite positioning grooves 2112 that extend in the axial direction, and an annular lower flange 2113 extending outward and radially from the outer annular surface 211. The cover plate 23 is mounted to a top of the main body 21, and is formed with an opening 231. The annular connecting seat 22 is mounted coaxially to a bottom of the main body 21, and cooperates with the main body 21 and the cover body 23 to define an inner receiving space 200 thereamong for receiving the circuit board 26 and the battery set. The connecting seat 22 has a bottom side formed with three openings 224 in spatial communication with the inner receiving space 200, and an externally threaded tubular protrusion 222 extending downward from the bottom side and aligned with a central opening 224. The cover bodies 223 are connected detachably to the connecting seat 22 for respectively covering the remaining two openings 224 in the connecting seat 22.

The circuit board 26 is disposed fixedly in the battery housing 20, and is adapted to be connected electrically to the battery set received in the battery housing 20. In this embodiment, the circuit board 26 is provided on and connected to a bottom side of the cover plate 23 of the battery housing 20, and extends in the axial direction through the central opening 224 in the connecting seat 22 into the tubular protrusion 222 of the connecting seat 22, as shown in FIG. 4.

The USB connector 24 is mounted on the circuit board 26, and is disposed in the tubular protrusion 222 of the connecting seat 22 of the battery housing 20. In this embodiment, a charge circuit (not shown) of the circuit board 26 is operable to charge the rechargeable batteries received in the battery housing 20 with an external electric power through the USB connector 24.

The lamp casing 3 encloses the power unit 2, and is connected movably to the battery housing 20 such that the lamp casing is movable relative to the battery housing 20 in the axial direction. In this embodiment, the lamp casing 3 includes a tube body 31, a transparent cap body 32, and a bowl-shaped body 33. The tube body 31 surrounds and is connected movably to the main body 21 of the battery housing 20. The tube body 31 has an inner annular surface 310 formed with opposite positioning protrusions 311 that extend in the axial direction and that engage movably and respectively the positioning grooves 2112 in the main body 21 of the battery housing 20. Each positioning protrusion 311 is formed with a through hole 3110 extending in the axial direction. In addition, the tube body 31 is connected to the main body 21 of the battery housing 20 by two bolt fasteners 25 each extending through the annular lower flange 2113 of the main body 21 and the through hole 3110 in a corresponding positioning protrusion 311 and anchored to an individual nut. The transparent cap 32 is connected to an upper end of the tube body 31. The bowl-shaped body 33 is connected detachably to a lower end of the tube body 31 for receiving the connecting seat 22 of the battery housing 20 therein (see FIGS. 4 and 5).

Figure 5:
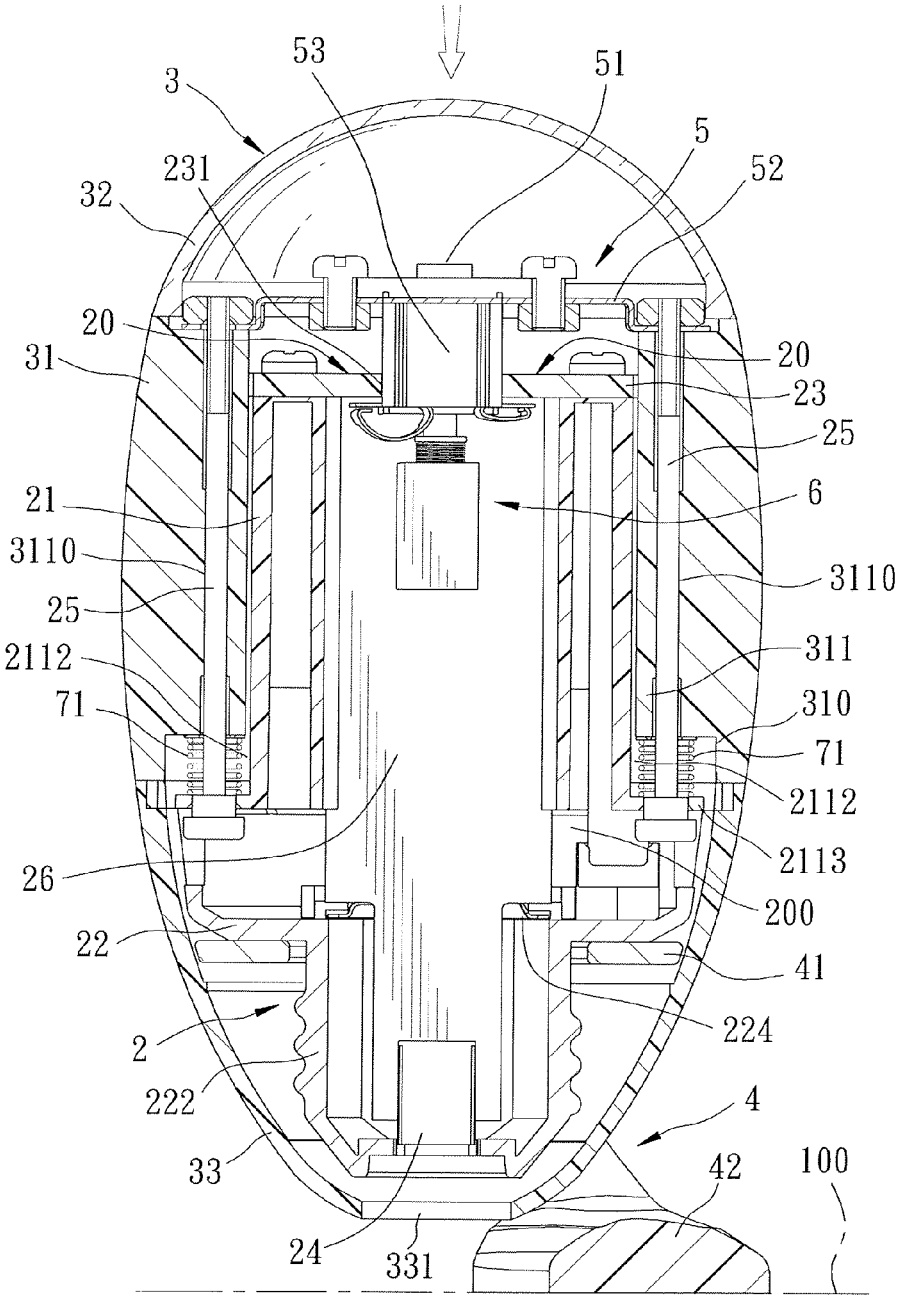
FIG. 5 is a schematic section view showing the preferred embodiment when a lamp housing is pressed.
Figure 6:
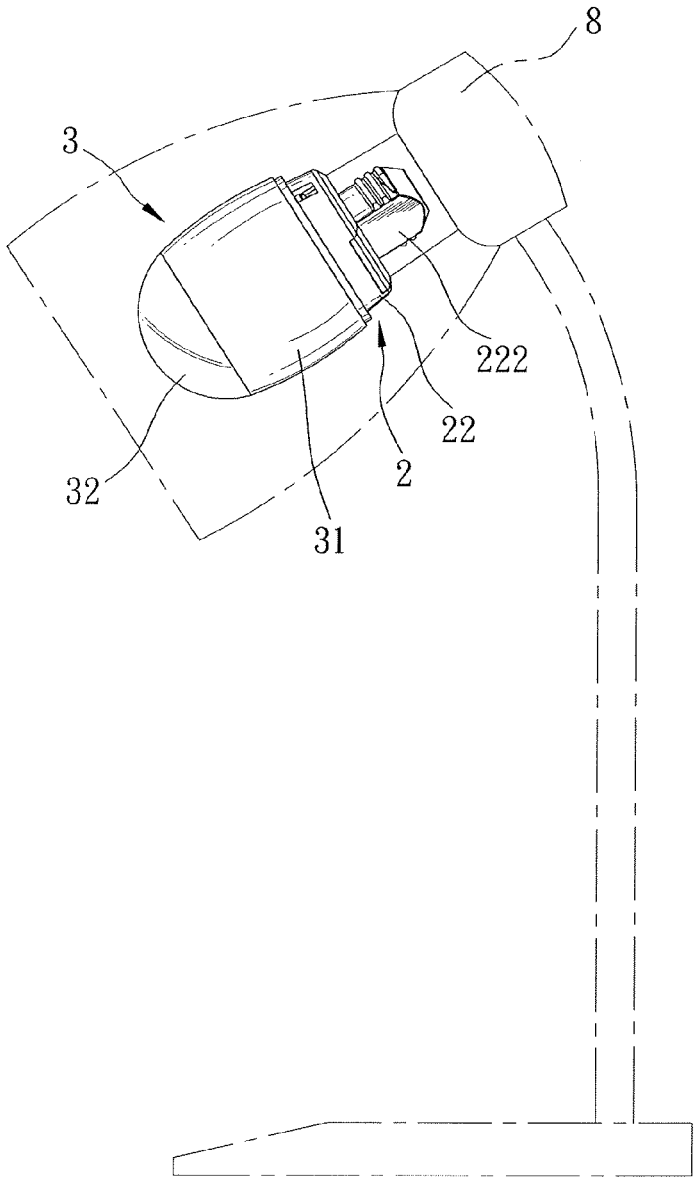
FIG. 6 is a schematic view showing the preferred embodiment without the base unit when installed to a table lamp.

The base unit 4 is used to support the power unit 2 on a supporting surface 100 (see FIGS. 4 and 5). In this embodiment, the base unit 4 includes two foot bodies 42, and an annular supporting plate 41. The foot bodies 42 are adapted to be placed on the supporting surface 100, and have upper ends extending into the bowl-shaped body 33 of the lamp casing 3. The annular supporting plate 41 is received in the bowl-shaped body 33 of the lamp casing 3, and is connected to the upper ends of the foot bodies 42 for supporting the connecting seat 22 of the battery housing 20 thereon. The annular supporting plate 41 permits extension of the tubular protrusion 222 of the connecting seat 22 therethrough, as shown in FIG. 4. In addition, the bowl-shaped body 33 has a bottom opening 331 such that the USB connector 24 is exposed through the bottom opening 331 in the bowl-shaped body 33.

The LED lighting unit 5 is mounted in and connected fixedly to the lamp casing 3, and is disposed spacedly above the circuit board 26. In this embodiment, the LED lighting unit 5 is covered by the transparent cap body 32 of the lamp casing 3, and includes a lamp-mounting plate 52 and an LED 51. The lamp-mounting plate 52 is mounted fixedly on the upper end of the tube body 31 of the lamp casing 3 using the bolt fasteners 25 extending therethrough. The LED 51 is mounted on the lamp-mounting plate 52. In addition, the LED lighting unit 5 further includes an actuating block 53 mounted on a bottom of the lamp-mounting plate 52, extending through the opening 231 in the cover plate 23 of the battery housing 20.

The power switch 6 is mounted on the circuit board 26, and is connected electrically between the LED 51 of the LED lighting unit 5 and the battery set received in the battery housing 20. The power switch 6 is disposed to be aligned with the opening 231 in the cover plate 23 of the battery housing 20. The power switch 6 is operable between a power-on state, where the LED 51 of the LED lighting unit 5 is connected electrically to the battery set via the power switch 6 such that the LED 52 emits light in response to supply of electric power from the battery set, and a power-off state, where the LED 52 of the LED lighting unit 5 is disconnected electrically from the battery set. As such, when the lamp casing 3 is pressed to move the LED lighting unit 5 toward the circuit board 26, the power switch 6 is actuated in response to movement of the LED lighting unit 5 toward the circuit board 26 to switch from a current one of the power-on and power-off states to the other one of the power-on and power-off states. In this embodiment, the power switch 6 is a press type switch such that, when the LED lighting unit 5 moves toward the circuit board 26 due to press of the lamp casing 3, the power switch 6 is pressed by the actuating block 53 to be actuated, as shown in FIG. 5.

The biasing member 7 is used to bias the lamp casing 3 to move away from the circuit board 26. In this embodiment, the biasing member 7 includes two coil springs 71. Each coil spring 71 is sleeved on a corresponding bolt fastener 25, is received in a corresponding positioning groove 2112 in the main body 21 of the battery housing 20, and is disposed between a corresponding positioning protrusion 311 of the tube body 31 of the lamp casing 3 and the annular lower flange 2113 of the main body 21 of the battery housing 20.

In sum, since the actuating block 53 of the LED lighting unit 5 moves with the lamp casing 3, the power switch 6 is easily operated by press of the lamp casing 3. In addition, since the LED 51 with lower power consumption and since the rechargeable batteries of the battery set is easily charged by an external power source through the USB connector 24, the lamp device of the present is suitable for outdoor use.

Moreover, when an assembly of the bowl-shaped body 33 and the base unit 4 is detached from the main body 31 of the lamp casing 3, the lamp device of the present invention can be installed to a table lamp through connection between the tubular protrusion 222 of the connecting seat 22 of the battery housing 20 and a lamp seat 8 of the table lamp. In this case, the lamp device of the present invention serves as a conventional light bulb.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A lamp device comprising:

a power unit including a battery housing adapted for receiving a battery set therein, and a circuit board disposed fixedly in said battery housing and adapted to be connected electrically to the battery set received in said battery housing;

a lamp casing enclosing said power unit, and connected movably to said battery housing such that said lamp casing is movable relative to said battery housing in an axial direction;

an LED lighting unit mounted in and connected fixedly to said lamp casing, and disposed spacedly above said circuit board of said power unit; and a power switch mounted on said circuit board and connected electrically between said LED lighting unit and the battery set received in said battery housing, said power switch being operable between a power-on state, where said LED lighting unit is connected electrically to the battery set via said power switch such that said LED lighting unit emits light in response to supply of electric power from the battery set, and a power-off state, where said LED lighting unit is disconnected electrically from the battery set received in said battery housing;

wherein, when said lamp casing is pressed to move said LED lighting unit toward said circuit board, said power switch is actuated in response to movement of said LED lighting unit toward said circuit board to switch from a current one of the power-on and power-off states to the other one of the power-on and power-off states.

2. The lamp device as claimed in claim 1, further comprising a base unit for supporting said power unit on a supporting surface.

3. The lamp device as claimed in claim 2, wherein said battery housing of said power unit includes:

a hollow main body extending in the axial direction;

a cover plate mounted to a top of said main body and provided with said circuit board thereon;

an annular connecting seat mounted coaxially to a bottom of said main body and cooperating with said main body and said cover body to define an inner receiving space thereamong for receiving said circuit board and the battery set, said connecting seat having a bottom side formed with a plurality of openings in spatial communication with said inner receiving space, and an externally threaded tubular protrusion extending downward from said bottom side and permitting extension of said circuit board thereinto; and a plurality of cover bodies connected detachably to said connecting seat for respectively covering said openings in said connecting seat.

4. The lamp device as claimed in claim 3, wherein said power unit further includes a USB connector mounted on and connected electrically to said circuit board, and disposed in said tubular protrusion of said connecting seat of said battery housing.

5. The lamp device as claimed in claim 3, wherein said lamp casing includes:

a tube body surrounding and connected movably to said main body of said battery housing, said tube body having a lower end, and an upper end mounted with said LED lighting unit thereon; and a transparent cap body connected to said upper end of said tube body for covering said LED lighting unit.

6. The lamp device as claimed in claim 5, wherein:

said base unit includes two foot bodies adapted to be placed on the supporting surface, and an annular supporting plate connected to upper ends of said foot bodies for supporting said connecting seat of said battery housing thereon and permitting extension of said tubular protrusion of said connecting seat therethrough; and said lamp casing further includes a bowl-shaped body connected detachably to said lower end of said tube body for receiving said connecting seat of said battery housing and said annular supporting plate of said base unit therein, said bowl-shaped body permitting extension of said upper ends of said foot bodies thereinto, and being detachably connected to said lower end of said tube body.

7. The lamp device as claimed in claim 5, further comprising a biasing member for biasing said lamp casing to move away from said circuit board of said power unit.

8. The lamp device as claimed in claim 7, wherein:

said main body of said battery housing has an outer annular surface formed with opposite positioning grooves that extend in the axial direction, and an annular lower flange extending outward and radially from said outer annular surface;

said tube body of said lamp casing has an inner annular surface formed with opposite positioning protrusions that extend in the axial direction and that engage movably and respectively said positioning grooves in said main body of said battery housing, each of said positioning protrusions being formed with a through hole extending in the axial direction, said tube body being connected to said main body of said battery housing by two bolt fasteners each extending through said annular lower flange of said main body and said through hole in a corresponding one of said positioning protrusions; and said biasing member includes two coil springs each sleeved on a corresponding one of said bolt fasteners, received in a corresponding one of said positioning grooves in said main body of said battery housing and disposed between a corresponding one of said positioning protrusions of said tube body of said lamp casing and said annular lower flange of said main body of said battery housing.

9. The lamp device as claimed in claim 5, wherein said LED lighting unit includes a lamp-mounting plate mounted fixedly on said upper end of said tube body of said lamp casing, and at least one LED mounted on said lamp-mounting plate and connected electrically to said power switch.

10. The lamp device as claimed in claim 9, wherein:

said cover plate of said battery housing is formed with an opening aligned with said power switch;

said power switch is a press type switch; and said LED lighting unit further includes an actuating block mounted on a bottom of said lamp-mounting plate, extending through said opening in said cover plate of said battery housing such that, when said LED lighting unit moves toward said circuit board due to press of said lamp casing, said power switch is pressed by said actuating block to be actuated.

* * * * *